US008280007B2

(12) United States Patent
Rogers et al.

(10) Patent No.: US 8,280,007 B2
(45) Date of Patent: Oct. 2, 2012

(54) APPARATUS AND METHOD FOR IMPROVED TRANSIENT RESPONSE IN AN ELECTROMAGNETICALLY CONTROLLED X-RAY TUBE

(75) Inventors: Carey Shawn Rogers, Brookfield, WI (US); Mark Alan Frontera, Ballston Lake, NY (US); Ethan James Westcot, Wauwatosa, WI (US); Aparna Chakrapani Sheila-Vadde, Bangalore (IN); Peter Andras Zavodszky, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 207 days.

(21) Appl. No.: 12/911,908

(22) Filed: Oct. 26, 2010

(65) Prior Publication Data

US 2012/0099701 A1 Apr. 26, 2012

(51) Int. Cl.
*H01J 35/30* (2006.01)

(52) U.S. Cl. ..... 378/137; 378/121

(58) Field of Classification Search ..... 378/4–20, 378/62, 119–144
See application file for complete search history.

(56) References Cited

U.S. PATENT DOCUMENTS

| | | | | |
|---|---|---|---|---|
| 6,128,367 | A | 10/2000 | Foerst et al. | 378/137 |
| 6,292,538 | B1 | 9/2001 | Hell et al. | 378/137 |
| 2002/0186816 | A1 | 12/2002 | Freudenberger et al. | 378/144 |
| 2010/0020937 | A1 | 1/2010 | Hautmann et al. | 378/137 |

FOREIGN PATENT DOCUMENTS

WO 2008155695 A1 12/2008

OTHER PUBLICATIONS

Schwartz, "Brazing: for the engineering technologist," Springer, 1995, p. 297.

*Primary Examiner* — Courtney Thomas
(74) *Attorney, Agent, or Firm* — Ziolkowski Patent Solutions Group, SC

(57) ABSTRACT

An x-ray tube assembly includes a vacuum enclosure having a cathode portion, a target portion, and a throat portion comprising a non-electrically conductive tube. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

20 Claims, 6 Drawing Sheets

APPARATUS AND METHOD FOR IMPROVED TRANSIENT RESPONSE IN AN ELECTROMAGNETICALLY CONTROLLED X-RAY TUBE

BACKGROUND OF THE INVENTION

Embodiments of the invention relate generally to diagnostic imaging and, more particularly, to an apparatus and method for improved transient response in an electromagnetically controlled x-ray tube.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating target structure for the purpose of distributing the heat generated at a focal spot. The target is typically rotated by an induction motor having a cylindrical rotor built into a cantilevered axle that supports a disc-shaped target and an iron stator structure with copper windings that surrounds an elongated neck of the x-ray tube. The rotor of the rotating target assembly is driven by the stator.

One skilled in the art will recognize that the operation described herein need not be limited to a single X-ray tube configuration, but is applicable to any X-ray tube configuration. For instance, in one embodiment the target and frame of the X-ray tube may be held at ground potential and the cathode may be maintained at the desired potential difference, while in another embodiment the X-ray tube may operate in a bipolar arrangement having a negative voltage applied to a cathode and a positive voltage applied to an anode.

An x-ray tube cathode provides an electron beam that is accelerated using a high voltage applied across a cathode-to-target vacuum gap to produce x-rays upon impact with the target. The area where the electron beam impacts the target is often referred to as the focal spot. Typically, the cathode includes one or more cylindrical-coil or flat filaments positioned within a cup for providing electron beams to create a high-power, large focal spot or a high-resolution, small focal spot, as examples. Imaging applications may be designed that include selecting either a small or a large focal spot having a particular shape, depending on the application. Typically, an electrically resistive emitter or filament is positioned within a cathode cup, and an electrical current is passed therethrough, thus causing the emitter to increase in temperature and emit electrons when in a vacuum.

The shape of the emitter or filament and the shape of the cathode cup that the filament is positioned within affects the focal spot. In order to achieve a desired focal spot shape, the cathode may be designed taking the shape of the filament and cathode cup into consideration. However, the shape of the filament is not typically optimized for image quality or for thermal focal spot loading. Conventional filaments are primarily shaped as coiled or helical tungsten wires for reasons of manufacturing and reliability. Alternative design options may include alternate design profiles, such as a coiled D-shaped filament. Therefore, the range of design options for forming the electron beam from the emitter may be limited by the filament shape, when considering electrically resistive materials as the emitter source.

Electron beam (e-beam) wobbling is often used to enhance image quality. Wobble may be achieved using electrostatic e-beam deflection or magnetic deflection (i.e., spatial modulation), which utilizes a rapidly changing magnetic field to control the e-beam. Likewise, a rapidly changing magnetic field may be used to rapidly change the focusing of the electron beam (i.e., change the cross-sectional size of the electron beam in width and length directions). Typically, a pair of quadrupole magnets are used to achieve electron beam focusing in both width and length directions. For certain scan modes, such as rapid kV modulation, or so-called dual-energy scanning, the ability to rapidly adjust the focusing magnetic field is advantageous to maintain the focal spot size constant between the kV levels. Such electromagnetic e-beam control may achieve a high image quality by ensuring that the electron beam moves from one position to the next or refocuses as quickly as possible while staying in the desired position or at the desired focus without straying. However, when current in the electromagnets is rapidly changed to generate the changing magnetic field, eddy currents are generated in the vacuum vessel wall that opposes the magnetic field penetration inside the x-ray tube. The eddy currents increase the rise time of the magnetic field inside the throat of the x-ray tube, which slows the deflection or refocusing time of the e-beam. Accordingly, it would be desirable to design an x-ray tube having a throat portion that minimizes eddy current losses to optimize the transient magnetic field developed at the electron beam.

The configuration of the x-ray tube throat is subject to a number of design constraints. During operation, the throat experiences significant heat fluxes in the x-ray tube environment due to backscattered electrons from the target, for example. Further, the throat should be easy to manufacture and easy to join with interface components while still being capable of maintaining a hermetic vacuum and withstanding atmospheric pressure.

Therefore, it would be desirable to design an apparatus and method for improving the transient response in an electromagnetically controlled x-ray tube that satisfies the above-described design constraints and overcomes the aforementioned drawbacks.

BRIEF DESCRIPTION OF THE INVENTION

In accordance with one aspect of the invention, an x-ray tube assembly includes a vacuum enclosure having a cathode portion, a target portion, and a throat portion comprising a non-electrically conductive tube. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

In accordance with another aspect of the invention, an x-ray tube assembly includes a housing having a vacuum formed therein. The housing includes a cathode portion, a target portion, and a throat portion coupling the cathode portion to the target portion. The throat portion comprises a magnetic field section constructed of a material that prevents eddy current generation therein. The x-ray tube assembly also includes a target positioned in the target portion of the housing, and a cathode positioned in the cathode portion of the housing to direct a stream of electrons toward the target through the throat portion.

In accordance with another aspect of the invention, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber having a target portion housing a target, a cathode portion housing a cathode, and a throat portion comprising a first electrical insulator. The throat portion forms a passageway between the cathode portion and the target portion for a stream of electrons emitted from the cathode. The imaging system also includes a first electron manipulation coil mounted on the x-ray tube and aligned with the first electrical insulator. The first electron manipulation coil is configured to generate a first magnetic field within the throat portion to manipulate the stream of electrons therein.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The operating environment of embodiments of the invention is described with respect to a computed tomography (CT) system. It will be appreciated by those skilled in the art that embodiments of the invention are equally applicable for use with any multi-slice configuration. Moreover, embodiments of the invention will be described with respect to the detection and conversion of x-rays. However, one skilled in the art will further appreciate that embodiments of the invention are equally applicable for the detection and conversion of other high frequency electromagnetic energy. Embodiments of the invention will be described with respect to a "third generation" CT scanner, but is equally applicable with other CT systems, surgical C-arm systems, and other x-ray tomography systems as well as numerous other medical imaging systems implementing an x-ray tube, such as x-ray or mammography systems.

Figure 1:
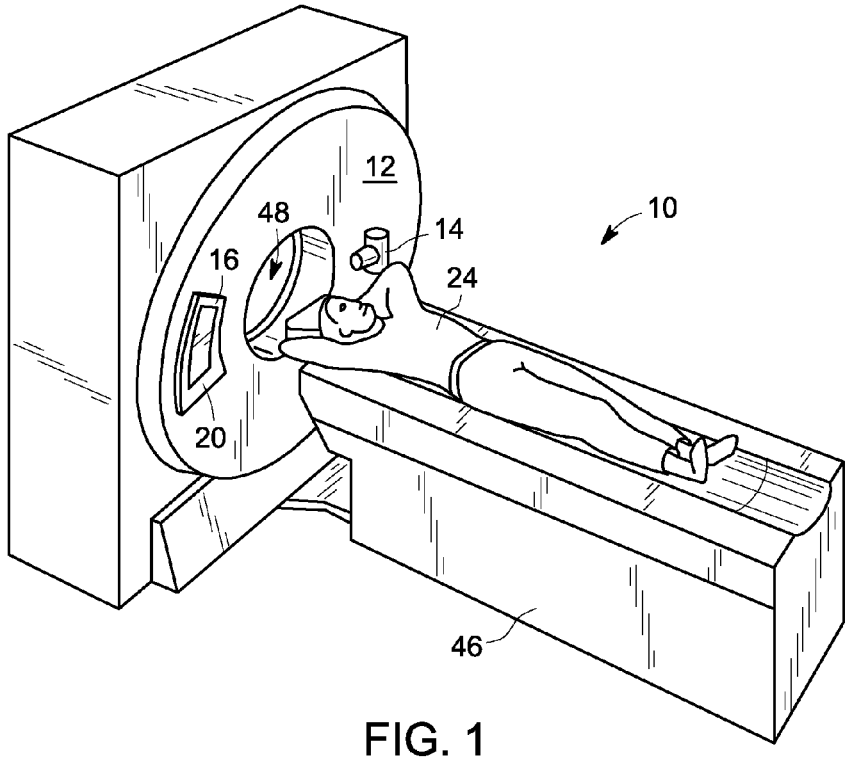
FIG. 1 is a pictorial view of an imaging system.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

Figure 2:
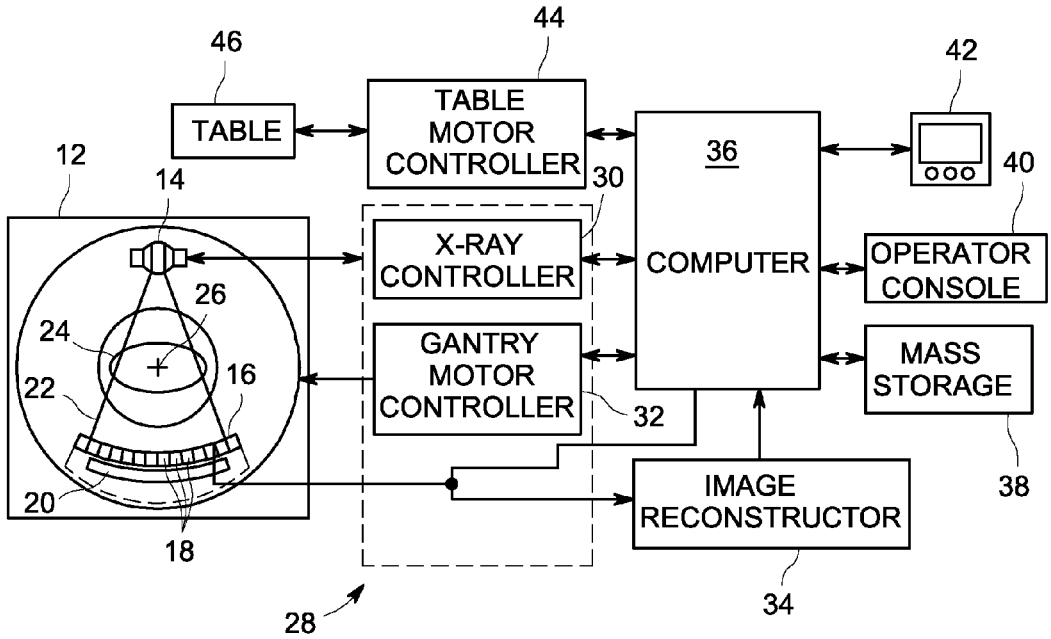
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray tube assembly or x-ray source assembly 14 that projects a cone beam of x-rays toward a detector assembly or collimator 16 on the opposite side of the gantry 12. Referring now to FIG. 2, detector assembly 16 is formed by a plurality of detectors 18 and data acquisition systems (DAS) 20. The plurality of detectors 18 sense the projected x-rays 22 that pass through a medical patient 24, and DAS 20 converts the data to digital signals for subsequent processing. Each detector 18 produces an analog electrical signal that represents the intensity of an impinging x-ray beam and hence the attenuated beam as it passes through the patient 24. During a scan to acquire x-ray projection data, gantry 12 and the components mounted thereon rotate about a center of rotation 26.

Rotation of gantry 12 and the operation of x-ray source assembly 14 are governed by a control mechanism 28 of CT system 10. Control mechanism 28 includes an x-ray controller 30 that provides power and timing signals to an x-ray source assembly 14 and a gantry motor controller 32 that controls the rotational speed and position of gantry 12. An image reconstructor 34 receives sampled and digitized x-ray data from DAS 20 and performs high speed reconstruction. The reconstructed image is applied as an input to a computer 36 which stores the image in a mass storage device 38. Computer 36 also has software stored thereon corresponding to electron beam positioning and magnetic field control, as described in detail below.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 20, x-ray controller 30 and gantry motor controller 32. In addition, computer 36 operates a table motor controller 44 which controls a motorized table 46 to position patient 24 and gantry 12. Particularly, table 46 moves patient 24 through a gantry opening 48 of FIG. 1 in whole or in part.

Figure 3:
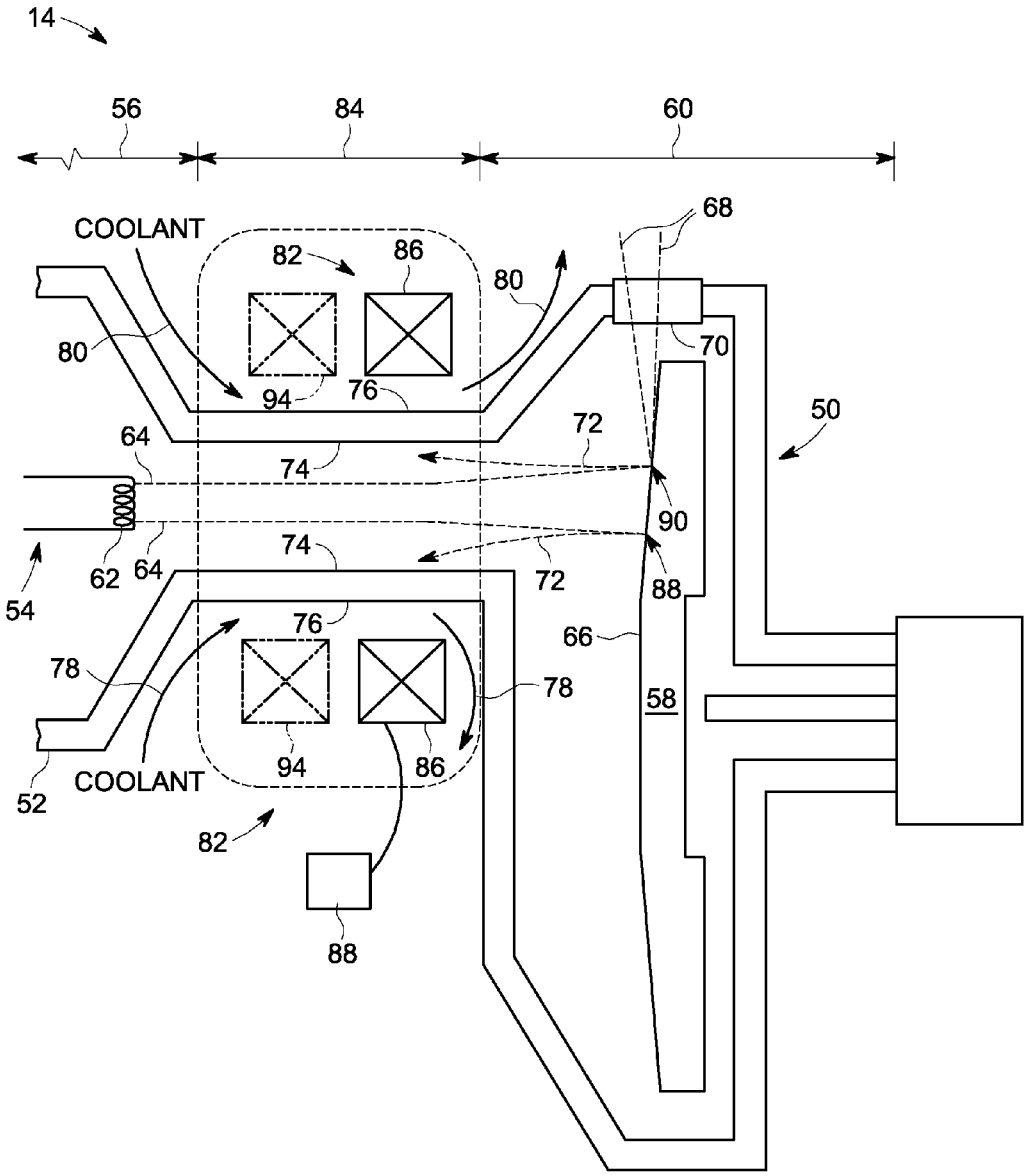
FIG. 3 is a cross-sectional view of an x-ray tube assembly according to an embodiment of the invention and useable with the imaging system illustrated in FIG. 1.

FIG. 3 illustrates a cross-sectional view of x-ray tube assembly 14 according to an embodiment of the invention. X-ray tube assembly 14 includes an x-ray tube 50 that includes a vacuum chamber or enclosure 52 having a cathode assembly 54 positioned in a cathode portion 56 thereof. A rotating target 58 is positioned in a target portion 60 of vacuum enclosure or housing 52. Cathode assembly 54 includes a number of separate elements, including a cathode cup (not shown) that supports a filament 62 and serves as an electrostatic lens that focuses a beam of electrons 64 emitted from heated filament 62 toward a surface 66 of target 58. A stream of x-rays 68 is emitted from surface 66 of target 58 and is directed through a window 70 of vacuum enclosure 52. A number of electrons 72 are backscattered from target 58 and impact and heat an inner surface 74 of vacuum enclosure 52. A coolant is circulated along an outer surface 76 of vacuum enclosure 52, as illustrated by arrows 78, 80 to mitigate heat generated in vacuum enclosure 52 by backscattered electrons 72.

A magnetic assembly 82 is mounted in x-ray tube assembly 14 at a location near the path of electron beam 64 within a throat portion 84 of vacuum enclosure 52, which is downstream from cathode portion 56 and upstream from target portion 60. Magnetic assembly 82 includes a first coil assembly 86. According to one embodiment, coil 86 is wound as a quadrupole and/or dipole magnetic assembly and is positioned over and around throat portion 84 of vacuum chamber 52 such that a magnetic field generated by coil 86 acts on electron beam 64, causing electron beam 64 to deflect and move along either the x- and/or y-directions. The direction of movement of electron beam 64 is determined by the direction of current flow though coil 86, which is controlled via a control circuit 88 coupled to coil 86. According to another embodiment, coil 86 is configured to control a focal spot size or geometry. Optionally, a second coil assembly 90 (shown in phantom) may also be included in magnetic assembly 82, as shown in FIG. 3. Coil assemblies 86, 90 may have dipole and/or quadrupole configurations, according to various embodiments and based on a desired electron beam control.

Embodiments of the invention set forth herein reduce the generation of eddy currents within the section of the x-ray tube throat 84 that is aligned with coil assemblies 86, 90, which allows the desired magnetic field to develop more rapidly. Eddy currents are developed in throat section 84 whenever the magnetic field is changing in magnitude, spatially or temporally. Eddy currents are not present when the magnetic field is unchanging. Consequently, the embodiments set forth herein are directed toward reducing the eddy current generation that would take place in a baseline metal throat section that is of a uniform cross-sectional thickness and volume, while simultaneously maintaining desired design specifications of throat section 84. Such design specifications may be, for example, that throat section 84 is hermetic, structurally robust to resist atmospheric pressure and other applied forces, thermally robust to heating primarily due to backscattered electrons, electrically conducting on an inside surface to provide a conduction path for collected charge, and joinable to cathode section 56 and target section 60 of vacuum enclosure 52.

Figure 4:
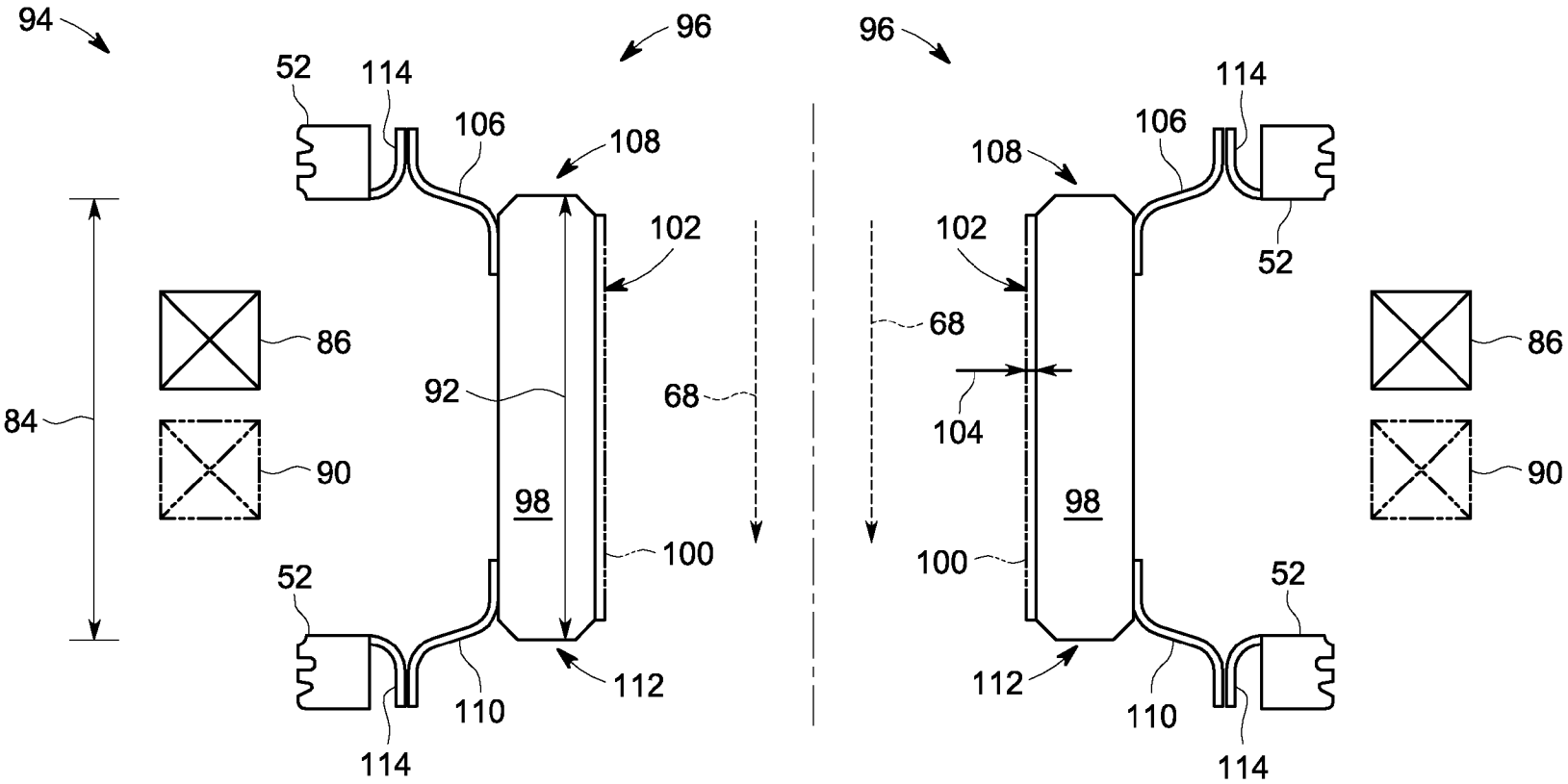
FIG. 4 is an enlarged portion of the throat of the x-ray tube assembly of FIG. 3, according to an embodiment of the invention.

FIG. 4 is an enlarged view of a subportion 94 of FIG. 3 that includes coil assembly 86 (FIG. 3) in accordance with an embodiment of the invention. Throat wall 96 includes a non-electrically conductive portion 98 aligned with coil assembly 86. Throat wall 96 may comprise a ceramic material such as alumina, graphite, boron nitride, or silicon nitride, or any similar electrically insulating material, according to various embodiments. Because throat wall 96 is non-electrically conducting, no eddy currents are generated in wall 96, and the magnetic field in throat portion 84 follows the electromagnet drive current waveform. Thus, wall thickness is not constrained. As shown, ceramic portion 98 has a length 92 approximately equal to the length of throat portion 84.

The electrically isolated ceramic throat may collect a floating charge from backscatter electrons and other charged particles. Thus, according to one embodiment, an optional thin metalized layer 100 (shown in phantom) may be applied to an inside surface 102 of ceramic portion 98 to provide a conduction path for absorbed charge to the body of the vacuum enclosure. Optional metalized layer 100 is affixed directly to ceramic portion 98 and has a thickness 104 large enough to provide some filtering of magnet current ripple effects as desired on the magnetic field inside vacuum enclosure 52 (FIG. 3). This coating 100 may be, for example, on the order of tens of microns thereby achieving very fast magnetic field rise times.

According to one embodiment, throat wall 96 includes a low-expansion metal header 106 that is coupled to an upstream side 108 of ceramic portion 98. Throat wall 96 also includes a low-expansion metal header 110 that is coupled to a downstream side 112 of ceramic portion 98. In a preferred embodiment, headers 106, 110 are a non-magnetic material such as 300 series stainless steel, Mo, an Inconel alloy, a Hasteloy alloy, or a nickel alloy, as examples. Metal headers 106 and 110 are joined by typical means, for example welding or brazing, at joint 114 to the tube vacuum frame housing.

One skilled in the art will recognize that ceramic portion 98 may be joined to vacuum enclosure 52 in a number of alternative manners. For example, as one alternative, ceramic portion 98 of throat wall 96 may be coupled to vacuum enclosure 52 using a sandwich seal braze, which includes layers of Cusil-ABA, a weld ring, Cusil-ABA, and ceramic.

Further, one skilled in the art will recognize that the embodiment set forth in FIG. 4 may be modified for an x-ray tube assembly having a pair of, or more, coil assemblies, such as, for example, optional second coil assembly 90 (shown in phantom), for focusing the electron beam in length and width directions and deflecting the electron beam along two axes.

Figure 5:
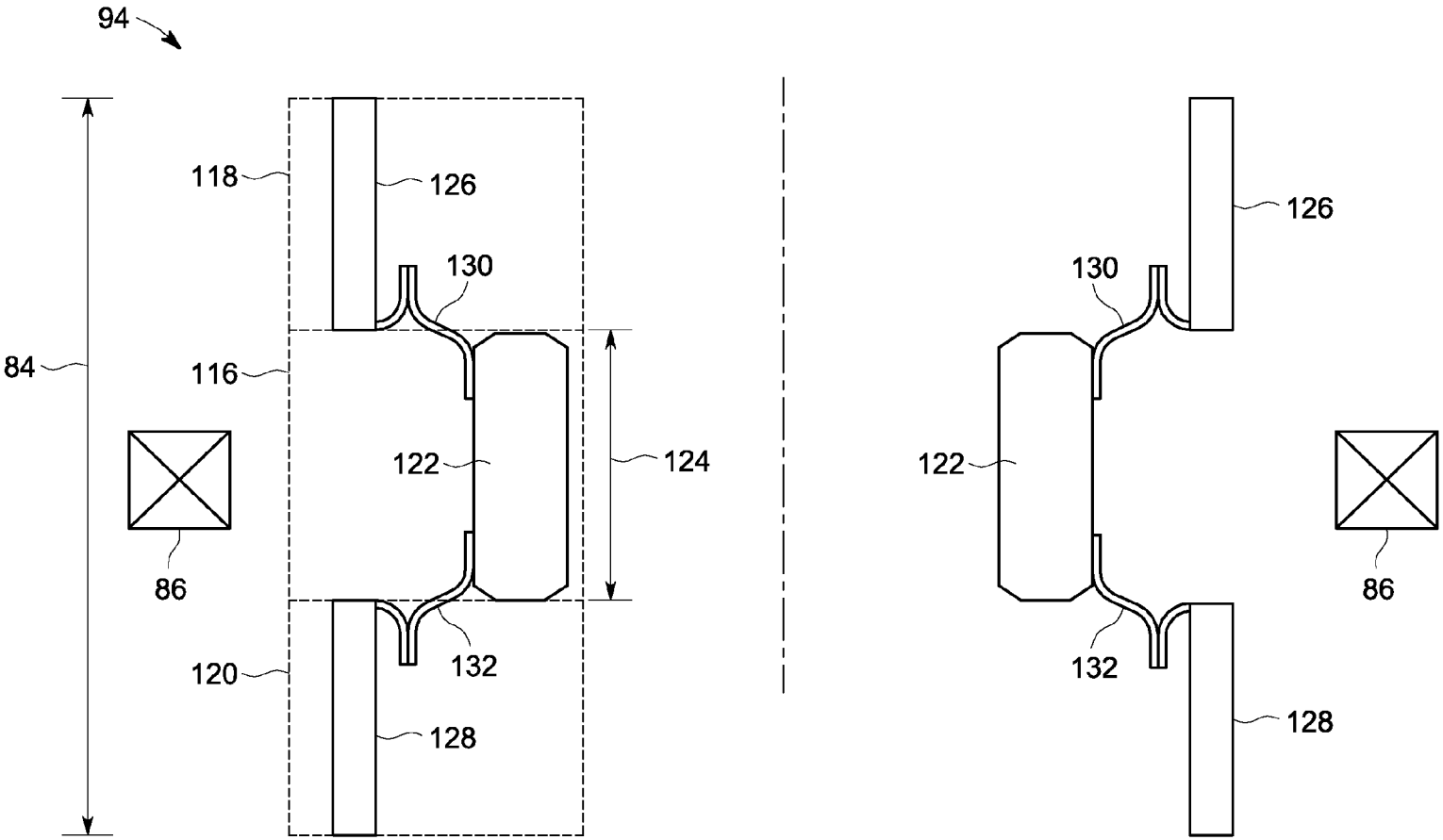
FIG. 5 is an enlarged portion of the throat of the x-ray tube assembly of FIG. 3, according to another embodiment of the invention.

Referring to FIG. 5, an enlarged view of subportion 94 of FIG. 3 is shown according to an alternative embodiment wherein throat portion 84 is divided into three sections: a magnetic field section 116, an upstream section 118, and a downstream section 120. As shown, magnetic field section 116 is aligned with coil assembly 86 and comprises a ceramic tube 122 that has a length 124 that is shorter than the length of throat portion 84. Upstream and downstream sections 118, 120 include respective metal wall sections 126, 128 that join ceramic section 116 to cathode and target portions 56, 60 of vacuum chamber 52 (FIG. 3). Headers 130, 132 join ceramic tube 122 to metal wall sections 126, 128 in a similar manner as described with respect to headers 106, 110 of FIG. 4. Likewise, one skilled in the art will recognize that multiple coil assemblies may be aligned with magnetic field section 116 in a similar manner as described with respect to FIG. 3.

Figure 6:
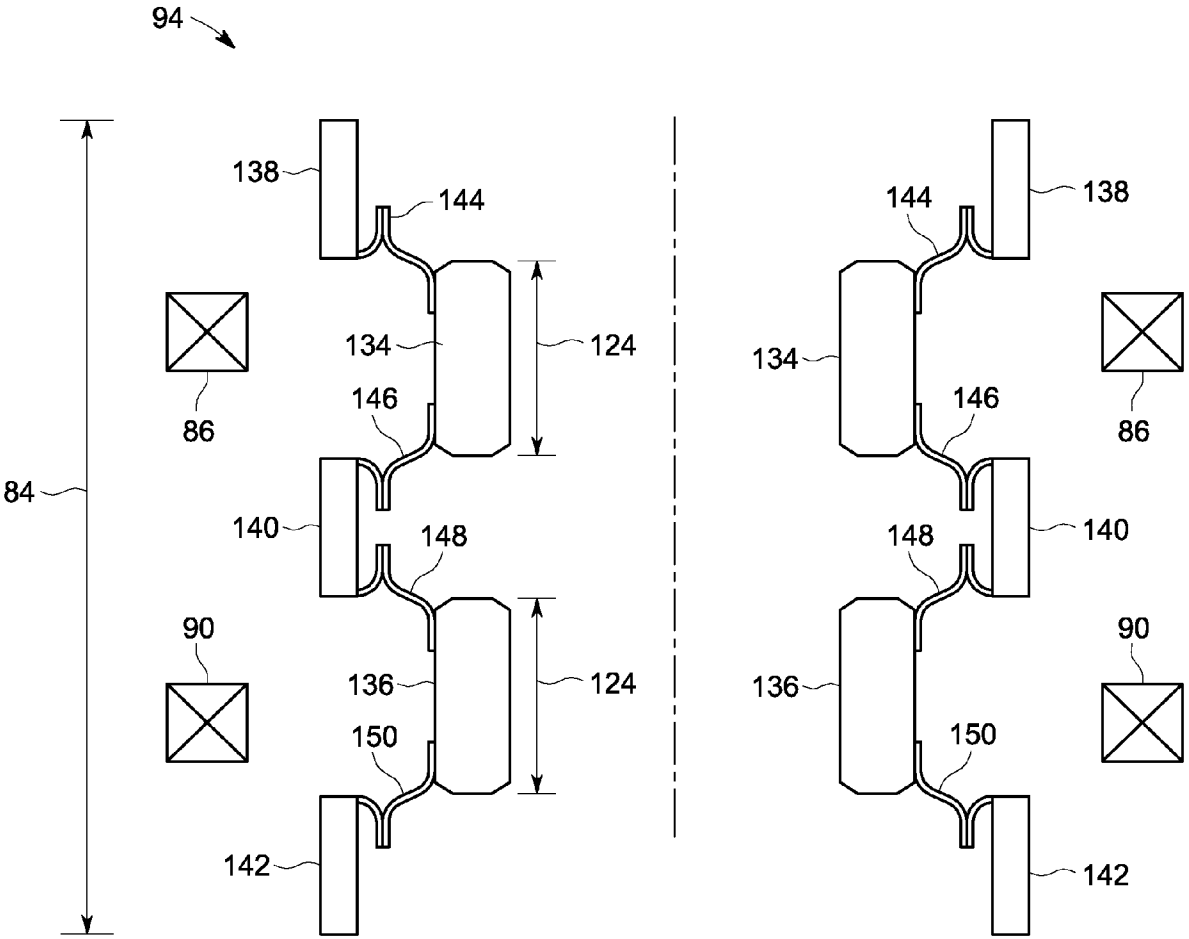
FIG. 6 is an enlarged portion of the throat of the x-ray tube assembly of FIG. 3, according to yet another embodiment of the invention.

FIG. 6 is an enlarged view of subportion 94 of FIG. 3, according to an alternative multiple coil embodiment. As shown, throat portion 84 includes a first non-conducting tube 134 aligned with coil assembly 86 and a second non-conducting tube 136 aligned with coil assembly 90. Wall portion 138 joins first non-conducting tube 136 with cathode portion 56 of vacuum chamber 52 (FIG. 3), wall portion 140 joins first and second non-conducting tubes 134, 136, and wall portion 142 joins second non-conducting tube 136 with target portion 60 of vacuum chamber 52 (FIG. 3). Headers 144, 146, 148, 150 join first and second non-conducting tubes 134, 136 to respective wall portions 138-142.

Figure 7:
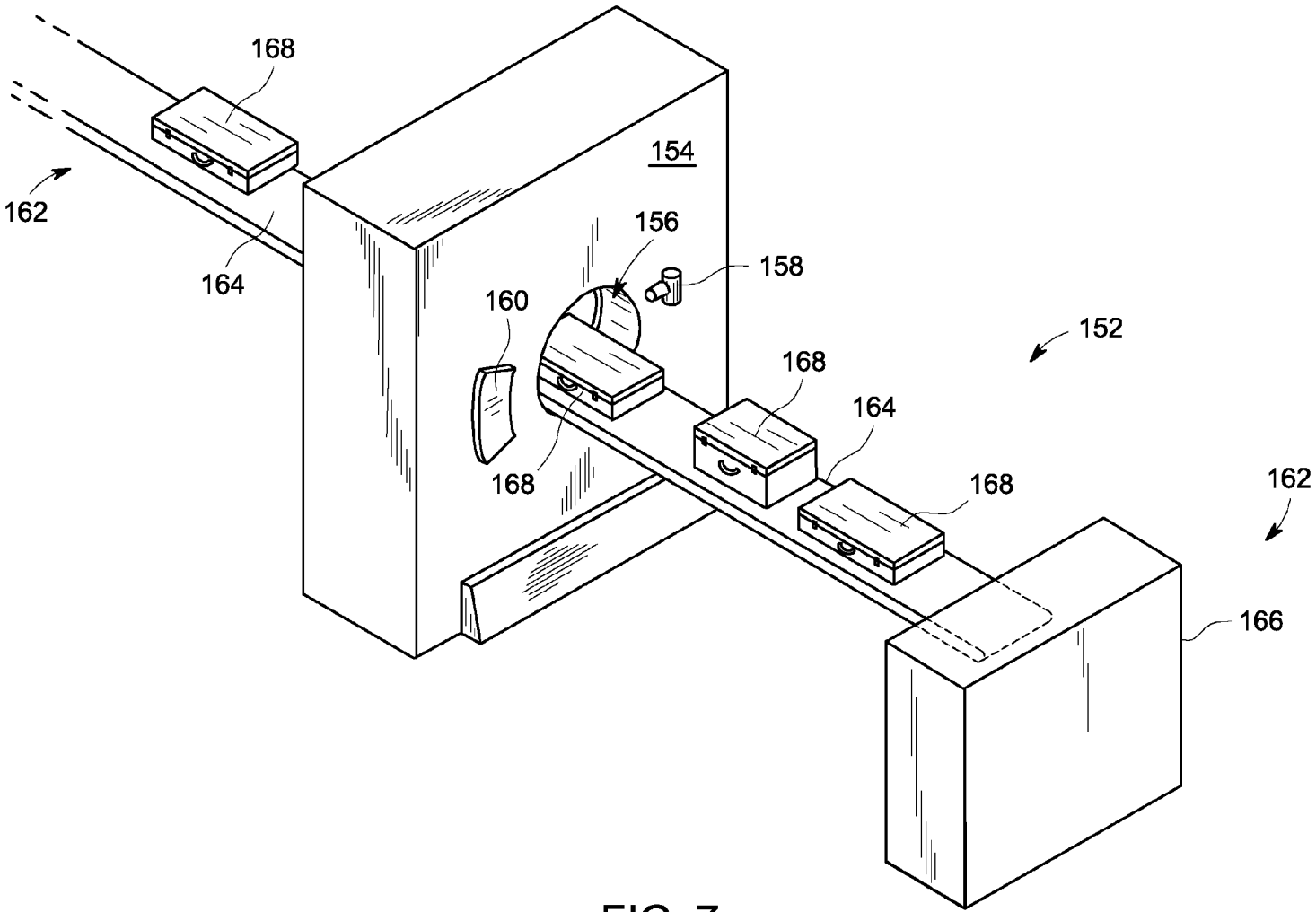
FIG. 7 is a pictorial view of an x-ray system for use with a non-invasive package inspection system according to an embodiment of the invention.

Referring now to FIG. 7, package/baggage inspection system 152 includes a rotatable gantry 154 having an opening 156 therein through which packages or pieces of baggage may pass. The rotatable gantry 154 houses a high frequency electromagnetic energy source 158 as well as a detector assembly 160 having detectors similar to those shown in FIG. 2. A conveyor system 162 is also provided and includes a conveyor belt 164 supported by structure 166 to automatically and continuously pass packages or baggage pieces 168 through opening 156 to be scanned. Objects 168 are fed through opening 156 by conveyor belt 164, imaging data is then acquired, and the conveyor belt 164 removes the packages 168 from opening 156 in a controlled and continuous manner. As a result, postal inspectors, baggage handlers, and other security personnel may non-invasively inspect the contents of packages 168 for explosives, knives, guns, contraband, etc.

Therefore, in accordance with one embodiment, an x-ray tube assembly includes a vacuum enclosure having a cathode portion, a target portion, and a throat portion comprising a non-electrically conductive tube. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

In accordance with another embodiment, an x-ray tube assembly includes a housing having a vacuum formed therein. The housing includes a cathode portion, a target portion, and a throat portion coupling the cathode portion to the target portion. The throat portion comprises a magnetic field section constructed of a material that prevents eddy current generation therein. The x-ray tube assembly also includes a target positioned in the target portion of the housing, and a cathode positioned in the cathode portion of the housing to direct a stream of electrons toward the target through the throat portion.

In accordance with yet another embodiment, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber having a target portion housing a target, a cathode portion housing a cathode, and a throat portion comprising a first electrical insulator. The throat portion forms a passageway between the cathode portion and the target portion for a stream of electrons emitted from the cathode. The imaging system also includes a first electron manipulation coil mounted on the x-ray tube and aligned with the first electrical insulator. The first electron manipulation coil is configured to generate a first magnetic field within the throat portion to manipulate the stream of electrons therein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray tube assembly comprising:

a vacuum enclosure comprising:

a cathode portion;

a target portion; and a throat portion comprising a non-electrically conductive tube, the throat portion having an upstream end coupled to the cathode portion and a downstream end coupled to the target portion;

a target positioned within the target portion of the vacuum enclosure; and a cathode positioned within the cathode portion of the vacuum enclosure, the cathode configured to emit a stream of electrons through the throat portion toward the target.

2. The x-ray tube assembly of claim 1 wherein the throat portion has a length defined by a distance between the upstream end and the downstream end; and wherein the non-electrically conductive tube has a length approximately equal to the length of the throat portion.

3. The x-ray tube assembly of claim 1 wherein the throat portion further comprises:

an upstream section;

a downstream section; and a magnetic field section mechanically coupled between the upstream section and the downstream section, the magnetic field section comprising the non-electrically conductive tube; and wherein a susceptibility of the upstream and downstream sections to generate eddy currents is greater than a susceptibility of the magnetic field section to generate eddy currents.

4. The x-ray tube assembly of claim 1 wherein the throat portion further comprises a second non-electrically conductive tube.

5. The x-ray tube assembly of claim 1 further comprising a metalized layer formed on an inner surface of the non-electrically conductive tube, the metalized layer electrically connected to a grounded portion of the x-ray tube assembly.

6. The x-ray tube assembly of claim 1 wherein the non-electrically conductive tube comprises a ceramic.

7. An x-ray tube assembly comprising:

a housing having a vacuum formed therein, the housing comprising:

a cathode portion;

a target portion; and a throat portion coupling the cathode portion to the target portion and comprising a magnetic field section constructed of a material that prevents eddy current generation therein; and a target positioned in the target portion of the housing; and a cathode positioned in the cathode portion of the housing to direct a stream of electrons toward the target through the throat portion.

8. The x-ray tube assembly of claim 7 further comprising a first electromagnetic coil positioned around the throat portion of the housing and aligned with the magnetic field section, the first electromagnetic coil configured to generate a first magnetic field having a maximum magnetic flux density developed in the magnetic field section of the throat portion.

9. The x-ray tube assembly of claim 8 comprising a second electromagnetic coil positioned around the throat portion of the housing and aligned with the magnetic field section, wherein the second electromagnetic coil is configured to generate a second magnetic field having a maximum magnetic flux density developed in the magnetic field section of the throat portion.

10. The x-ray tube assembly of claim 8 wherein the magnetic field section of the throat portion has a length approximately equal to a length of the throat portion.

11. The x-ray tube assembly of claim 7 wherein the throat portion further comprises:

a first metal wall coupled between the magnetic field section and the cathode portion of the housing; and a second metal wall coupled between the magnetic field section and the target portion of the housing.

12. The x-ray tube assembly of claim 7 further comprising a metalized layer formed on an inner surface of the magnetic field section.

13. The x-ray tube assembly of claim 7 wherein the magnetic field section comprises a ceramic.

14. An imaging system comprising:

a rotatable gantry having an opening therein for receiving an object to be scanned;

a table positioned within the opening of the rotatable gantry and moveable through the opening;

an x-ray tube coupled to the rotatable gantry, the x-ray tube comprising:

a vacuum chamber comprising:

a target portion housing a target;

a cathode portion housing a cathode; and a throat portion comprising a first electrical insulator, the throat portion forming a passageway between the cathode portion and the target portion for a stream of electrons emitted from the cathode; and a first electron manipulation coil mounted on the x-ray tube and aligned with the first electrical insulator, the first electron manipulation coil configured to generate a first magnetic field within the throat portion to manipulate the stream of electrons therein.

15. The imaging system of claim 14 further comprising a second electron manipulation coil mounted on the x-ray tube adjacent to the first electron manipulation coil, the second electron manipulation coil configured to generate a second magnetic field within the throat portion to manipulate the stream of electrons therein.

16. The imaging system of claim 15 wherein the second electron manipulation coil is aligned with the first electrical insulator.

17. The imaging system of claim 16 wherein the throat portion further comprises a second electrical insulator positioned downstream of the first electrical insulator; and wherein the second electron manipulation coil is aligned with the second electrical insulator.

18. The imaging system of claim 14 wherein the first electrical insulator has a length substantially equal to a length of the throat portion.

19. The imaging system of claim 14 further comprising a metalized layer formed on an inner surface of the first electrical insulator.

20. The imaging system of claim 14 wherein the first electrical insulator is coupled to the cathode and throat portion via a pair of metal headers.

* * * * *